US007047669B2

(12) United States Patent
Polcek

(10) Patent No.: US 7,047,669 B2
(45) Date of Patent: May 23, 2006

(54) HIGH HEEL SHOE CUSHION SYSTEM

(76) Inventor: Norma Ellen Polcek, 1019 Braeburn La., Rockford, IL (US) 61107

( * ) Notice: Subject to any disclaimer, the term of this patent is extended or adjusted under 35 U.S.C. 154(b) by 7 days.

(21) Appl. No.: 10/743,607

(22) Filed: Dec. 22, 2003

(65) Prior Publication Data

US 2005/0132611 A1 Jun. 23, 2005

(51) Int. Cl.
*A43B 13/00* (2006.01)

(52) U.S. Cl. ..... 36/25 R; 36/30 R; 36/24.5; 36/44

(58) Field of Classification Search ..... 36/25 R, 36/30 R, 28, 24.5, 43, 44
See application file for complete search history.

(56) References Cited

U.S. PATENT DOCUMENTS

| | | | | |
|---|---|---|---|---|
| 526,234 | A | | 9/1894 | Kee |
| 1,273,292 | A | | 7/1918 | Vescio |
| 2,150,895 | A | | 3/1939 | Leone |
| 2,209,280 | A | | 7/1940 | Noonan |
| 2,299,305 | A | | 10/1942 | Ciaio |
| 2,348,336 | A | | 5/1944 | Everston |
| 2,377,460 | A | | 6/1945 | Strong |
| 2,405,224 | A | | 8/1946 | Margolin |
| 2,437,227 | A | | 3/1948 | Hall |
| 2,547,480 | A | | 4/1951 | McDaniel |
| 2,572,670 | A | | 10/1951 | Schwartz |
| 2,691,832 | A | * | 10/1954 | Lurie ..... 36/140 |
| 4,182,055 | A | * | 1/1980 | Turner, Jr. ..... 36/30 R |
| 4,364,188 | A | * | 12/1982 | Turner et al. ..... 36/31 |
| 4,429,473 | A | | 2/1984 | Blumenstein |
| 4,667,423 | A | * | 5/1987 | Autry et al. ..... 36/102 |
| 4,794,707 | A | * | 1/1989 | Franklin et al. ..... 36/107 |
| 5,012,596 | A | * | 5/1991 | Schiller ..... 36/11.5 |
| 5,435,077 | A | | 7/1995 | Pyle |
| 6,038,790 | A | * | 3/2000 | Pyle et al. ..... 36/30 R |
| 6,101,743 | A | * | 8/2000 | Brown ..... 36/102 |

* cited by examiner

*Primary Examiner*—Marie Patterson

(57) ABSTRACT

A high heel shoe includes a cushiony midsole secured between the forepart of the insole and the outsole. The insole is padded and formed with a generally open forepart that is filled with a flexible insert. The midsole includes a stabilizing outer perimeter.

23 Claims, 6 Drawing Sheets

HIGH HEEL SHOE CUSHION SYSTEM

CROSS-REFERENCE TO RELATED APPLICATIONS

None

Reference to sequence listing, table, or computer program listing appendix submitted on a compact disc: N/A.

Statement regarding federally sponsored research or development: N/A.

BACKGROUND OF THE INVENTION

1. Field of Invention

This invention relates generally to women's shoes.

More specifically, the invention relates to shoes that are especially adapted for comfort when worn for long periods of time, and which, while suitable for use in connection with many types of shoes, is especially suitable for use in high heel shoes. The aim is to create a comfortable shoe so that the wearer can comfortably walk all day and dance all night, and still be elegant; a "graceful" shoe suitable to be worn for both day and evening.

2. Background Art

At a wedding or some event where there is dancing, women are dressed in their finest attire and special shoes. Through the course of the evening, women will start to indicate how they are suffering because their shoes are causing great pain. Women can be seen with their shoes off. This is especially true when wearing high heel shoes. The higher the heel, the more pressure to the ball of the foot, and the more discomfort as the evening wears on. It is generally believed by those skilled in the art that creating a truly comfortable shoe with a heel over two inches is next to impossible. With, for example, a two and one-half inch heel, it is believed that the wearer will have five times one's body weight going through the ball of the foot, and a three inch heel results in seven times more stress on the forefoot than a one inch heel.

A typical, conventional shoe includes an upper secured in fixed relation to an insole, an outsole secured to the bottom of the insole, and a heel that extends down from the back of the outsole. Some shoes also include a platform or wedge, typically as part of the outsole at the forepart or at the back of the shoe.

Through the years there have been many attempts to bring comfort to women's shoes, with a particular emphasis on high heel shoes. For example, prior shoes have used insoles padded with various materials. After worn for a period of time, the insole padding tends to compress due to the weight of the wearer, and the initial softness becomes firm under the wearer's foot. In many instances, these materials initially have very little or no appreciable cushioning effect. The outsoles of some prior shoes are made from rubber or other material that is softer than conventional leather soles. However, such outsoles tend to be rather bulky, and are not suitable for high fashion type shoes.

The present invention addresses these problems with a shoe that remains soft and "cushy" and can be comfortably worn for extended periods of time.

SUMMARY OF THE INVENTION

The primary object of the invention is to create a new and improved shoe with a unique construction to provide comfort advantages over prior shoes, and which, while suitable for many types of shoes, is especially suitable for use in high heel shoes.

In general, the features of the preferred embodiments of the invention are realized with the combination of a uniquely constructed cushioned insole layered on top of a uniquely constructed cushioned midsole to create an interaction of cushioned materials at the forepart of the shoe. The combination divides the pressure created by the foot between the cushion parts so that each component absorbs a portion of the pressure and the combination remain soft and comfortable under the wearer's foot even when the shoe is worn for extended periods of time.

In accordance with one aspect of the invention, a soft "cushiony" midsole part is provided between the outsole and a padded insole at the forepart of the shoe.

One preferred midsole part is made from an open-cell natural or synthetic rubber material, characterized with a compression deflection of approximately 25% with a compressive pressure of between approximately 2 to 12 psi applied thereto. The insole spreads the wearer's weight over the entire surface of the midsole to provide long-lasting, cushiony support at the entire forepart of the shoe. Alternate cushiony midsole construction may be provided.

In accordance with another aspect of the invention, a preferred insole is formed with a generally open forepart that is covered over with the insole cushion. This cutout permits the weight of the wearer to transfer through the insole cushion to the soft midsole without encountering the firmness of the insole material.

In accordance with yet another aspect of the invention, a preferred insole further includes a flexible insert, such as made from canvas or other thick fabric or soft leather or imitation leather, secured in position in the cutout. This insert substantially fills the thickness of the space of the cutout to prevent the insole cushion from compressing into the space of the cutout, and assists in transfer of the wearer's weight through the insole cushion and into the cushiony midsole.

In accordance with still another aspect of the invention, a preferred midsole includes a firm perimeter at the outer perimeter of the shoe profile, and the soft cushiony center midsole part as described above. The midsole perimeter is established with sufficient firmness to dimensionally stabilize the sides of the midsole, and prevent the sides of the midsole from significantly or undesirably visibly bulging out due to the weight of the wearer transferring compressively into the cushiony midsole part of the shoe. One preferred stabilizing midsole perimeter is made from a natural or synthetic open-cell rubber material, characterized with a compression deflection of approximately 25% with a compressive pressure of at least approximately 20 psi applied thereto, and is compressively wrapped with a flexible fabric, leather or imitation leather material. Alternate stabilizing midsole perimeter construction may be provided.

These and other objectives and advantages of the invention will become more apparent from the following detailed description when taken in conjunction with the accompanying drawings.

Accordingly, a shoe in accordance with one preferred embodiment of the invention includes an upper secured in fixed relation to an insole, a midsole secured to the bottom forepart of the insole, an outsole secured to the midsole at the forepart of the shoe and to the insole at the heel end of the shoe, and a heel that extends downwardly from the outsole to establish the raised high heel configuration shoe. The insole is covered with a cushion. The midsole is constructed with a relatively firm perimeter, and a relatively soft, cushiony center. The forepart of the insole is formed with a cutout aligned over the cushiony center of the midsole, and a flexible insert generally fills the cutout such that the wearer's weight is absorbed by and transfers through the insole cushion and the insert to the midsole cushion.

Figure 1:
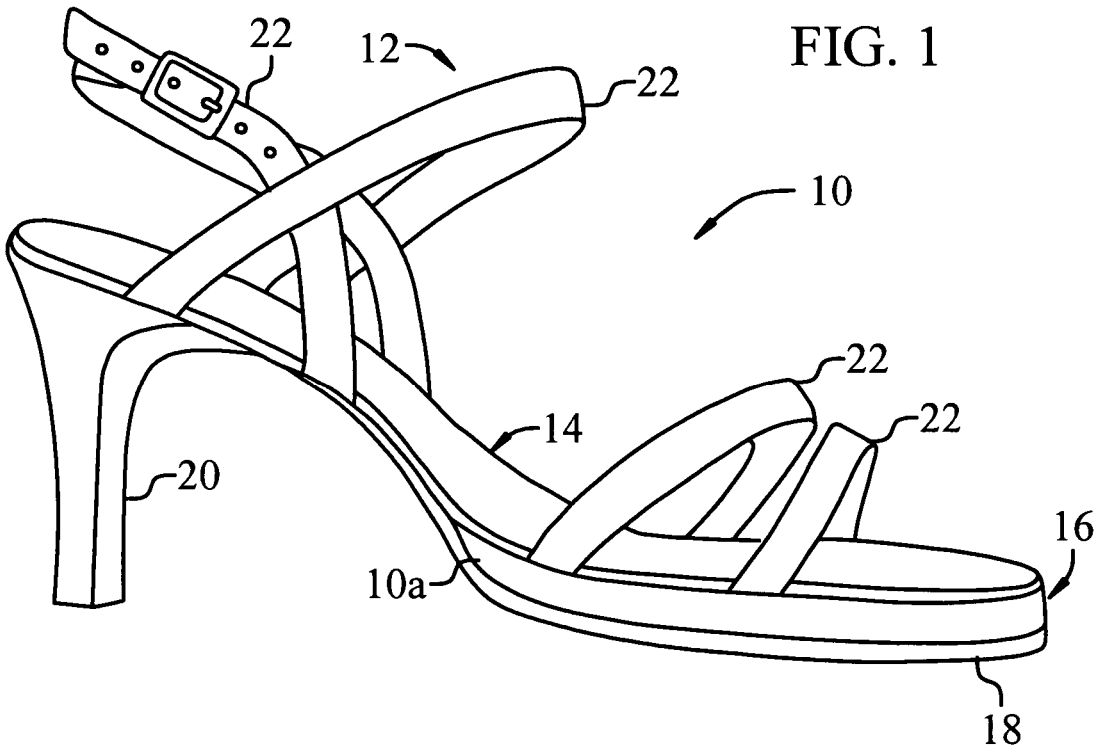
FIG. 1 is a perspective view of a high heel shoe incorporating the unique aspects of the invention, the shoe being shown in the form of a fashion sandal.
Figure 2:
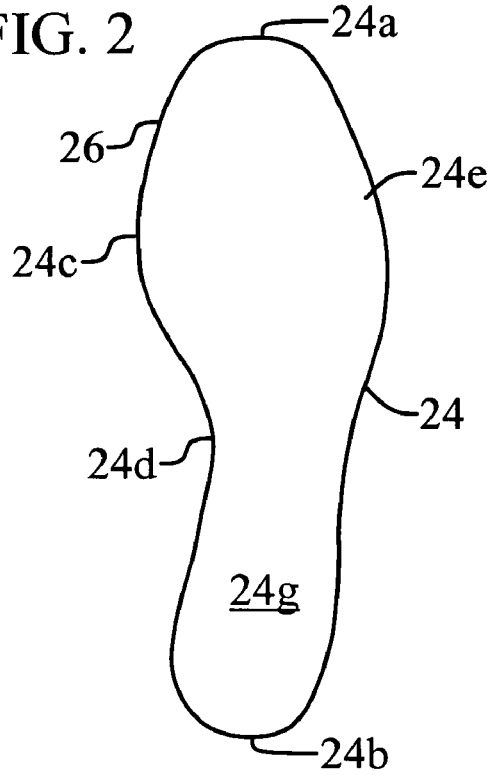
FIG. 2 is a bottom plan view of an insole blank for use in fabrication of a padded insole for the shoe shown in FIG. 1.
Figure 3:
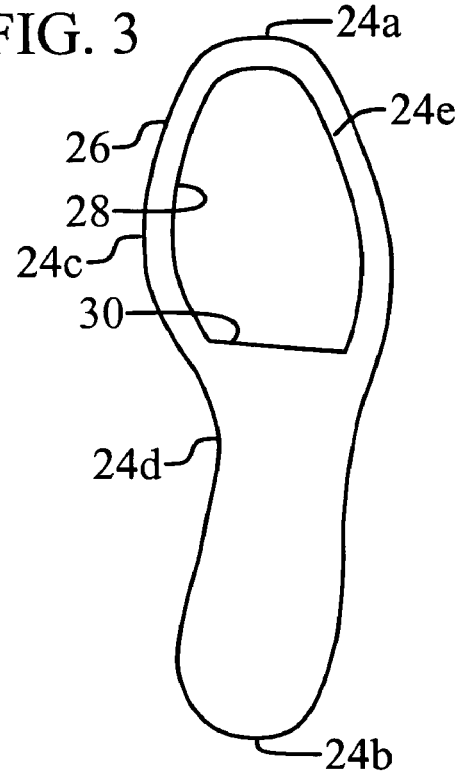
FIG. 3 is a bottom plan view showing a cutout formed in the forepart of the insole blank.
Figure 4:
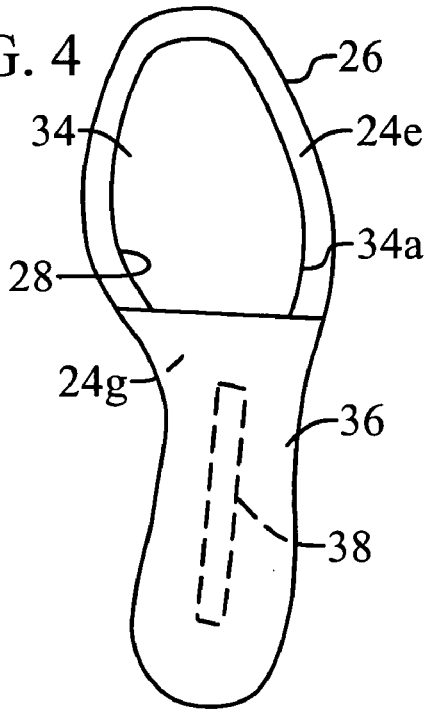
FIG. 4 is a bottom view plan showing an insert secured in the cutout and a shank and shoe tuck secured to the bottom of the insole blank.
Figure 5:
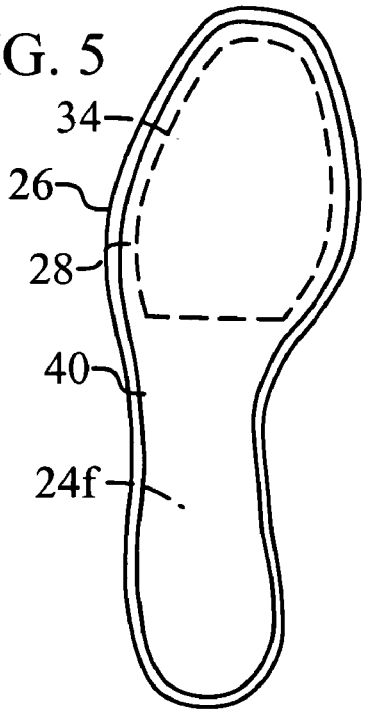
FIG. 5 is top plan view showing a cushion secured to the top of the insole blank.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings as embodied in a shoe 10 (FIG. 1) that includes an upper 12, an insole 14, a midsole 16, an outsole 18 and high heel 20. The upper 12 is provided with generally conventional or convenient construction for the type of shoe desired, such as an open upper for the sandal-type shoe 10 shown, with one or more straps 22 for securing the shoe to the wearer's foot. The upper can be provided in any style desired, such as, but not limited to, an upper for a partially or substantially closed high heel shoe, or an upper for either a low or a high heel boot. The upper is made from any suitable material to obtain any desired fashion or appearance of the shoe. The outsole 18 and heel 20 are also of generally conventional or convenient construction as desired. The outsole is typically made from leather, imitation leather, or rubber material, but can be made from any other material suitable for outsoles. The heel is conventionally made with a center support shank, and then covered with a desired material, such as but not limited to leather, imitation leather, fabric, acrylic, or painted, to visibly, functionally or fashionably compliment the upper, the midsole and the insole of the shoe. More recent shoe construction includes use of an outsole and high heel that are integrally molded from rubber or plastic as a single part. Still other high heel type shoes are commonly referred to as wedge shoes, in which the heel is generally wedge-shaped when viewed from the side to raise the heel end of the outsole and insole to the desired height above the forepart of the shoe. The present invention can be used with all of these, and other types and configuration uppers, outsoles and heels. Designation of the specific configurations and materials of these parts of the shoe are not a part of the present invention, but are included only to provide for a complete shoe. The construction of the invention can be used universally for any style of shoe.

Figure 7:
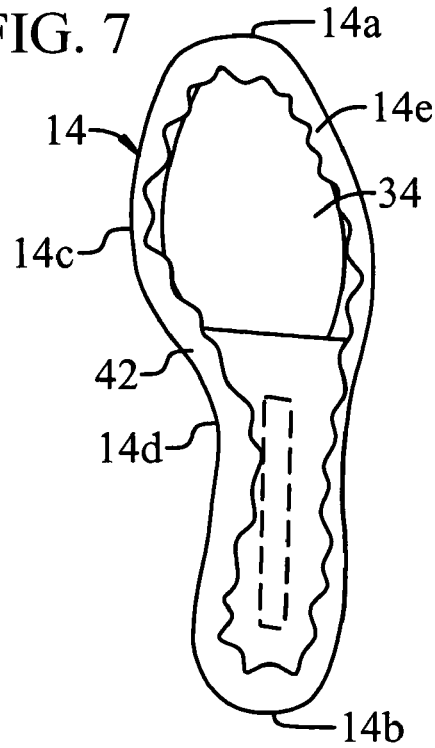
FIG. 7 is a bottom plan view showing the insole covering wrapped around the padded insole and secured to the bottom of the insole blank and the shoe tuck.
Figure 8:
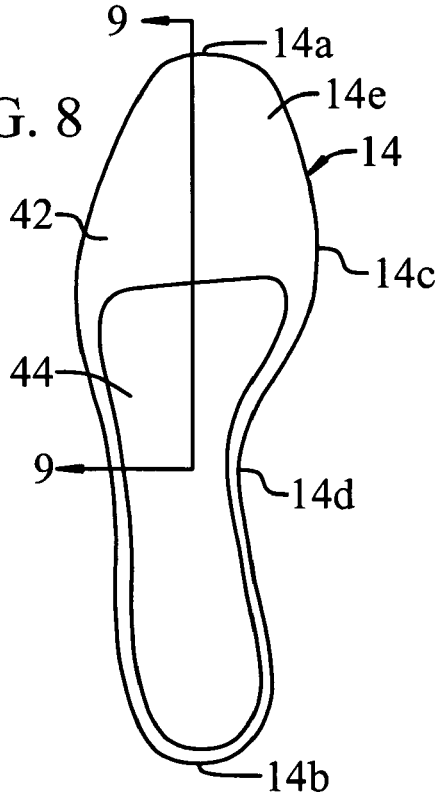
FIG. 8 is a top plan view showing a heel seat secured in position to insole covering to complete the insole.
Figure 9:
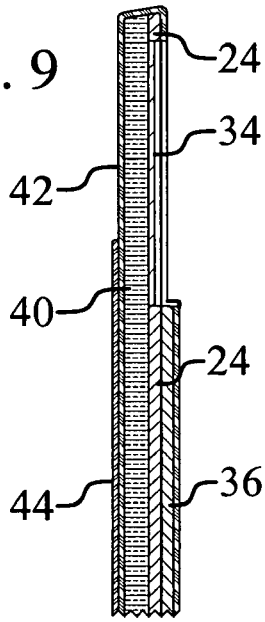
FIG. 9 is a cross-sectional view taken along the line 9—9 of FIG. 8.
Figure 10A:
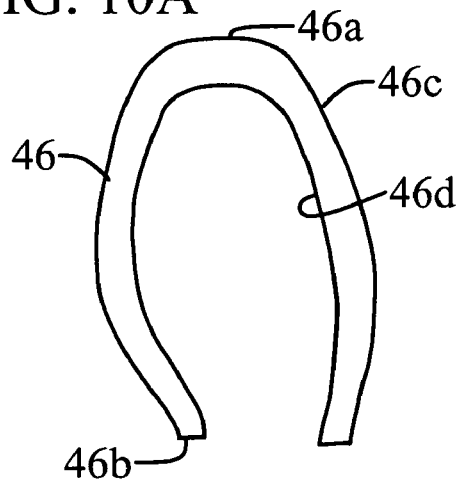
FIGS. 10A and 10B are top plan views of a stabilizing midsole perimeter part and a cushiony center midsole part for use in fabrication of the midsole of the shoe shown in FIG. 1.
Figure 10B:
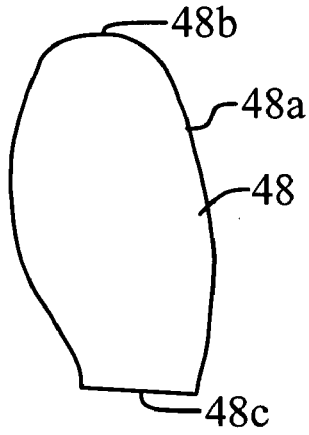

In a conventional manner, the insole 14 is configured with the foot-shape profile (see FIGS. 7 and 8) of the shoe, with a toe end 14*a*, a heel end 14*b*, an outwardly projecting profile 14*c* corresponding to the position of the ball of the foot shape, an arch profile 14*d* corresponding to the position of the arch of the foot shape, and a forepart 14*e* established between the toe end 14*a* and the arch profile 14*d*.

FIGS. 2–9 illustrate the construction of the insole 14 configured in accordance with a preferred embodiment of the invention. Initially, an insole blank 24 (FIG. 2) is provided from Texon brand material, or an equivalent tough, suitable insole material. The insole blank is provided with the desired outer profile 26 corresponding to the desired foot-shape profile of the finished insole and the finished shoe, and thus includes a toe end 24*a*, a heel end 24*b*, projection 24*c*, an arch profile 24*d* and a forepart 24*e* corresponding to the shape of the finished insole 14. The insole blank is provided at any convenient thickness, such as, but not limited to, at commercially available thickness of between approximately 3/64 to 1/16 inch thick.

In a preferred embodiment, the insole 24 is formed with a generally open forepart 24*e* having a stabilizing outer perimeter. In this instance, a cutout area 28 (FIG. 3) is formed through the thickness of the forepart 24*e* of the insole 24, between the top and bottom sides, 24*f*, 24*g*, thereof. The cutout 28 is formed with an inside profile that generally tracks the outer profile 26 of the forepart 24*e* of the insole 24. The back edge 30 of the cutout 28 extends across substantially the width of the insole, and is located in the arch profile 24*d* of the foot-shape behind the projection 24*d* where the ball of the wearer's foot will be located in the finished shoe. This location generally corresponds to the location 10*a* (FIG. 1) on the finished shoe that angles upwardly from the forepart of the shoe towards the top of the heel 20. Within material strength considerations, the preferred cutout 28 is provided as large as possible in the forepart of the insole. As will become understood below, increasing the size of the cutout 28 results in increased comfort to the wearer, by establishing midsole cushioned support under at least the entire forepart of the wearer's foot.

An insole cushion 40 (FIG. 5) is attached to the top side 24*f* of the insole blank 24. The insole cushion 40 extends over the cutout 28, and preferably over the entire top of the insole blank. The cushion is provided at a convenient thickness, such as, but not limited to, between approximately ⅛ to 5/16 inch thick. A tuck 36 and embedded shank 38 (shown in dashed lines in FIG. 4) are secured to the bottom side 24*g* of the insole blank. The tuck extends generally between the arch profile 24*d* and heel end 24*b* of the insole blank. The tuck and shank are of conventional or convenient rigid construction to provide structural support to the heel end 14*b* of the insole to support the weight of the wearer at the heel end of the shoe.

In the preferred embodiment, a flexible insert 34 (FIG. 4) is secured in position in the cutout 28 to support the portion of the cushion 40 located over the cutout 28. The insert is preferably sized and provided with an outer profile 34*a* that tracks the inside profile of the cutout 28 to at least substantially fill the space in the insole blank established by cutout. In this instance, the insert 34 is installed into the cutout 28 through the open back side, and is glued or otherwise secured to the bottom side of the cushion 40 facing therethrough, or otherwise secured in position in the cutout. The insert 34 is made from flexible leather, imitation leather, canvas or other durable fabric, or other material that is generally characterized as being more flexible than the material of the insole blank. The thickness of the insert 34 is preferable approximately equal to the material thickness of the insole blank. With this configuration, the insert generally prevents the cushion from deforming or permanently compressing into the space of the cutout from the wearer's weight on the forepart of the shoe. The flexible insert also assists in transferring the wearer's weight on the forepart of the shoe directly into the cushioned midsole discussed below. Alternately, for example, the top cushion 40 may be provided with a suitable backing layer that covers at least the cutout 28 and protects the cushion from permanently deforming into the space of the cutout as a result of the weight of a person wearing the shoe over extended periods of time.

Figure 6:
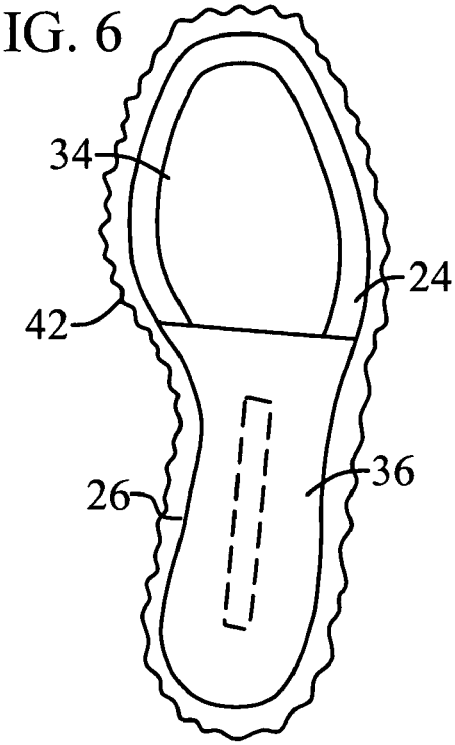
FIG. 6 is a bottom plan view of an insole covering as laid flat and the insole blank and secured insert, shank, tuck and cushion layer resting thereon.

A covering is secured over what would otherwise be exposed portions of the insole blank 24, the cushion 40, and the tuck 36 and the shank 38 in the finished shoe. As shown in FIG. 6, one covering 42 generally tracks the shape of and is slightly larger than the size of the insole blank. The edges of the covering are then wrapped snugly around the edges of the insole blank, the top cushion, and the tuck (FIG. 7), and glued or otherwise secured in position on the bottom side of the insole blank and tuck. The covering 42 is made from leather, imitation leather, fabric, or any other convenient material to obtain the desired fashion and appearance in the finished shoe. Alternately, for example, a covering may be provided as a sheet, sized to cover the forepart of the insole blank and cushion 40, and a strip wrapped around the edges of the exposed center and heel end components of the insole. The insole 14 is completed by securing a heel seat 44 (FIG. 8), such as made from leather, imitation leather, fabric, etc., to the top side of the covering 42 or the cushion 40. The completed insole is shown in cross-section in FIG. 9.

Figure 11:
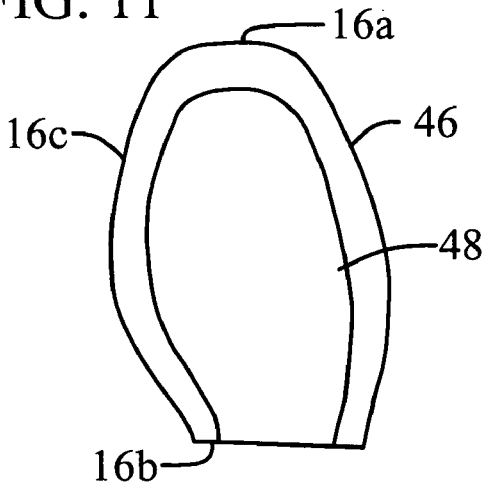
FIG. 11 is a top plan view of the midsole parts shown in FIGS. 10A and 10B as assembled together.
Figure 12:
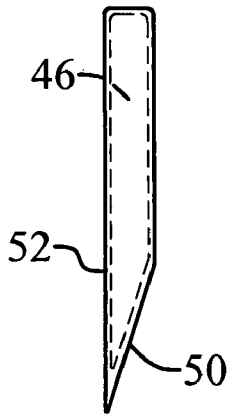
FIG. 12 is a side elevational view of the midsole parts shown in FIGS. 10A and 10B as assembled together.
Figure 13:
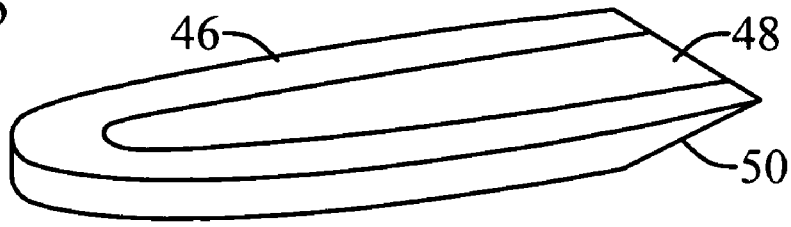
FIG. 13 is a perspective view of the midsole parts shown in FIGS. 10A and 10B as assembled together.
Figure 14:
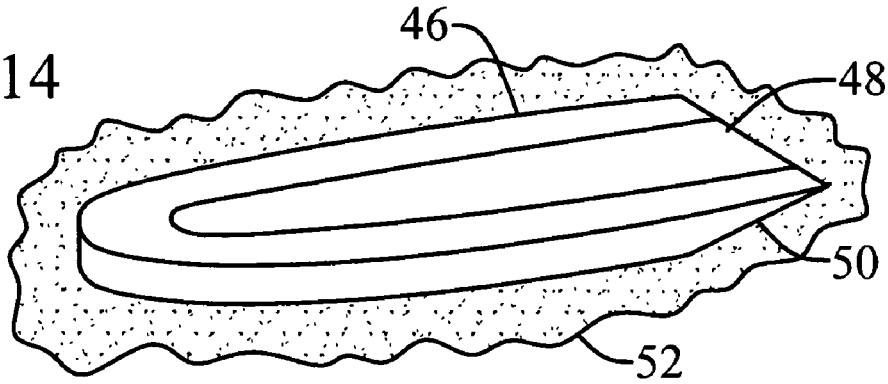
FIG. 14 is a perspective view of a midsole covering as laid flat and the midsole parts shown in FIGS. 10A and 10B resting thereon.
Figure 15:
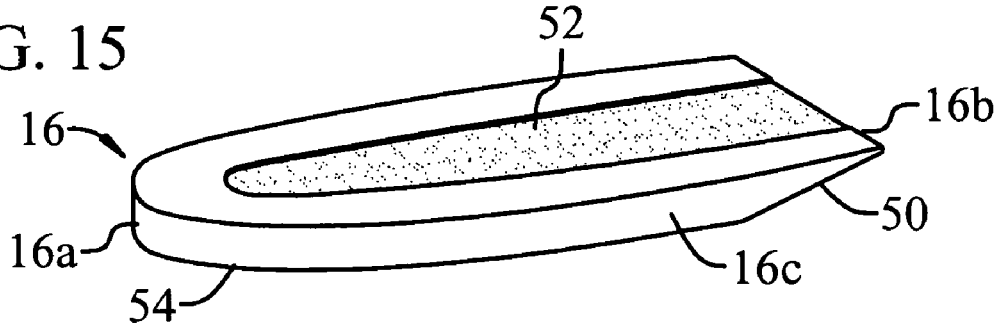
FIG. 15 is a perspective view of the finished midsole.

The midsole 16 is configured with the forepart of the foot-shape profile of the shoe 10, and is provided with a toe end 16*a* (see FIGS. 11 and 15), an arch profile end 16*b* and an outwardly projecting profile 16*c* therebetween corresponding to the toe end 14*a*, the center arch profile 14*d*, and the projecting profile 14*c* of the insole 14.

FIGS. 10–15 illustrate the construction of the midsole 16 configured in accordance with a preferred embodiment of the invention. In this instance, the midsole includes an outer, generally horseshoe shaped part 46 (FIG. 10A) and a center part 48 (FIG. 10B). The outer part 46 is provided with a toe end 46*a* and an arch end 46*b* corresponding to the toe end 24*a* and the arch profile 24*d* of the insole blank 24, and an outer profile 46*c* that tracks the profile 26 of the forepart 14*e* of the insole 14 to establish the outer profile or exposed perimeter of the midsole. The midsole outer part 46 is further provided with an inside profile 46*d* that generally tracks the inside profile of the cutout 28 in the insole blank 24. The center part 48 is sized and provided with an outer profile 48*a* that tracks the inside profile 46*d* of the midsole outer part 46 to fill the inside space established between the ends 46*a*, 46*b* thereof. Accordingly, the center part includes a toe end 48*b* proximate the toe end 46*a* of the outer part 46, and an arch end 48*c* that is proximate to, and in the embodiment shown, corresponds to the arch end 46*b* of the outer part 46.

For typical shoe construction, the outsole 18 curves slightly upwardly so that the toe end of the shoe is raised slightly with the shoe resting on the floor. Consequently, the midsole 16, and therefore, the outer and center parts 46, 48 of the midsole shown, are preferably provided with a slightly decreasing or variable or other thickness configuration to achieve the raised outsole at the toe end of the shoe. The arch end of the midsole, and therefore, the arch ends 46*b*, 48*c* of the midsole outer and center parts, are cut at a complimentary bevel 50 that tapers down at the free ends thereof, generally to a point or line thickness. As shown in FIG. 1, the taper 50 establishes the transition between the forepart of the shoe 10 with the midsole 16 connected between the insole 14 and the outsole 18, and heel end of the shoe with the outsole connected to the insole. The location of the front edge of the taper generally corresponds to the location of the back edge 30 of the cutout 28 in the insole, and to the location 10*a* on the finished shoe that angles upwardly from the flat forepart of the shoe. As a result, the full thickness of the midsole is under the entire forepart of the wearer's foot in the finished shoe. The midsole parts may optionally continue rearwardly from the forepart of the shoe, such as with a thin cushiony midsole center construction, as additional midsole cushion is desired towards or at the heel end of the shoe.

In general, the midsole outer part 46 is provided from a relatively firm material, and the midsole center part 48 is provided from a relatively soft cushiony material. The perimeter width of the midsole outer part 46, between its outer profile 46*c* and its inside profile 46*d*, is established, in consideration with the firmness and strength of the selected material, to establish a firm outer perimeter at the profile of the shoe forepart, so as to prevent the sides of the midsole 16 from visibly bulging when the shoe is walked in. In preferred embodiments, this perimeter thickness is minimized to the extent reasonably possible, so as to maximize the size of the softer midsole center part 48 under the forepart of the wearer's foot.

In one preferred embodiment, the midsole stabilizing outer part 46 is cut from a firm cushion material, such as a natural or synthetic open-cell rubber material, characterized with a compression deflection of approximately 25% with a compressive pressure of at least approximately 20 psi applied thereto. Suitable materials include, but are not limited to EPDM, neoprene polyurethane or natural open-cell or closed-cell foam. In alternate embodiments, the outer midsole perimeter is made from, for example, a molded plastic or rubber that is characterized as relatively firm in outwardly directions, to stabilize the profile of the midsole as the shoe is walked in, but that is sufficiently flexible perpendicular thereto for comfortable walking. Such alternate embodiments are particularly suitable for high quantity, lower cost production of shoes in accordance with the invention. In an additional alternate embodiment, the outer stabilizing perimeter of the midsole may be provided with a leather compressive wrap around the midsole center part.

In one preferred embodiment, the soft "cushiony" midsole center part 48 is cut from cushion material, such as a natural or synthetic open-cell rubber material, characterized with a compression deflection of approximately 25% with a compressive pressure of between approximately 2 to 12 psi applied thereto. In alternate embodiments, the midsole center cushion is provided, for example, in the form of an air-bubble or "air" cushion, or with gel-type cushion construction with the above-noted "cushiony" characteristics.

By way of further non-limiting example, for one preferred low-profile shoe, the midsole outer part 46 is provided at between approximately ⅛ to ⅜ inch thick, and the midsole center part 48 is provided with at least the same thickness as the outer part or slightly thicker than the outer part (See FIG. 12) to insure good cushioning contact under the forepart of the wearer's foot during extended wear of the shoe. The actual thickness of the midsole will be provided as appropriate for the shoe style, such at approximately one inch thick for higher profile shoes, and may be alternately configured with an additional thickness at the top to functionally replace the flexible insert 34 in the cutout 28 of the insole 24.

During fabrication of the midsole 16, the center part 48 is assembled into the outer part 46 (FIG. 11), and the two assembled parts secured together, and are preferably, snugly wrapped with an outer flexible layer. In the embodiment shown, the outer layer 52 (FIG. 14) is a thin fabric sheet sized to be wrapped around and secured to the assembled parts 46 and 48. Alternately, for example, the outer layer is established with separate top and bottom layers of fabric secured to the top and bottom surfaces of the assembled parts. The outer exposed perimeter edges of the secured midsole parts can then be covered with a material that compliments the upper 12, or the shoe design and appearance generally, such as wrapped along the edges with a strip 54 (FIG. 15) of leather, imitation leather, fabric or other desired material.

Figure 16:
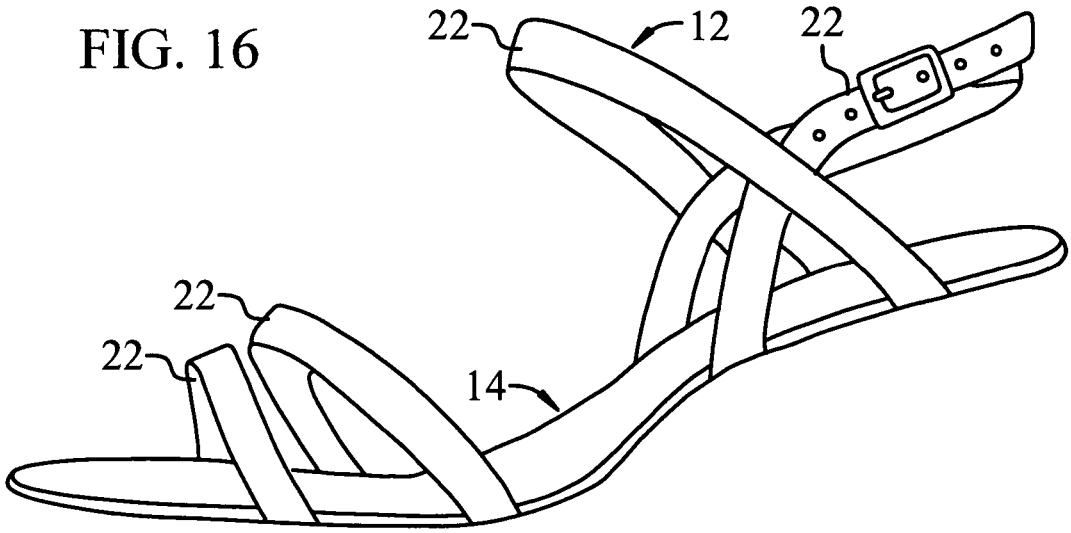
FIG. 16 is a perspective view showing an intermediate step in fabrication of the shoe, with the upper in fixed position with the insole.
Figure 17:
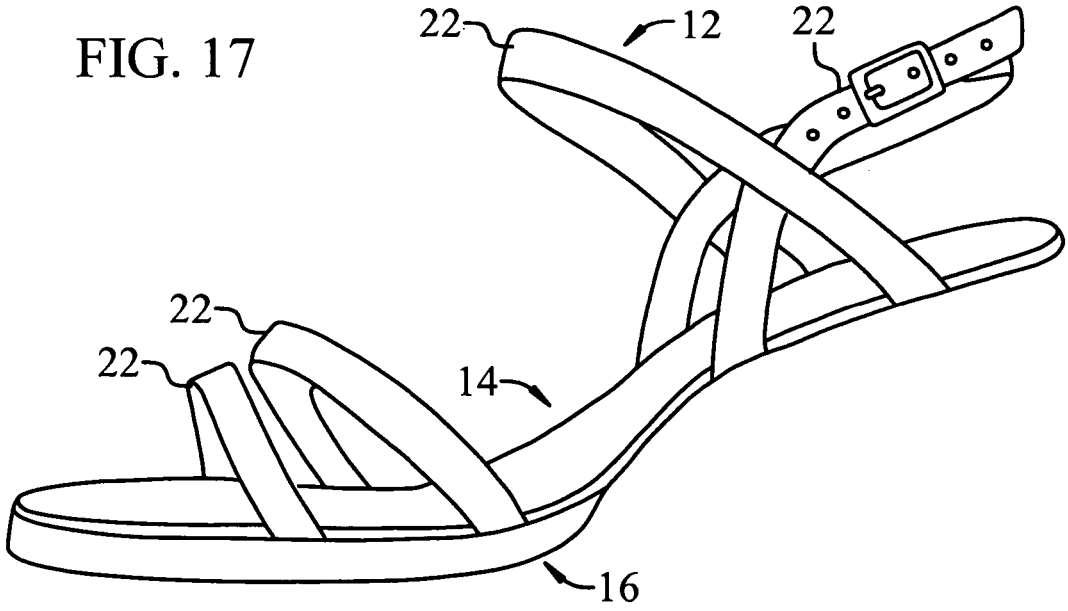
FIG. 17 is a perspective view showing a second intermediate step in the fabrication of the shoe, with the midsole in fixed position with the forepart of the insole prior to completion of the shoe as shown in FIG. 1.

The shoe 10 is assembled as generally shown in FIGS. 16–17 and FIG. 1. The finished insole 14 (FIG. 8) and the upper 12, or parts thereof such as the straps 22 shown, are glued or otherwise secured together. The top of the finished midsole 16 (FIG. 15) is secured (FIG. 17) to the bottom of the forepart of the insole such that the cushiony midsole center 48 is aligned under the open cutout 28 in the insole, and the stabilizing outer perimeter 46 of the midsole is aligned under the forepart perimeter of the insole. The outsole 18 is secured to the bottom of the midsole (FIG. 1), and the heel end of the outsole is secured to the heel end of the insole. The high heel shoe is completed with the heel connected to the heel end of the outsole, and extending downwardly therefrom to raise the heel end of the outsole and insole to a height above the foreparts of the shoe.

Those skilled in the art will recognize and readily understand that shoes in accordance with invention may be provided in alternate embodiments and alternate shoe construction not shown in the drawings or otherwise discussed above. For example, alternate assembly techniques will be used by the skilled artisan for convenience, or to obtain the desired shoe fashion or design. The upper may be secured between appropriate parts (outsole, midsole and insole) as they are otherwise secured together. To achieve a different look, the insole and midsole may be wrapped together, with a single fabric, leather or other flexible sheet or strip. The insole may be alternately provided with one or more narrow stabilizing Texon insole material strips remaining across the width of the cutout with associated flexible inserts therein, or alternately without the cutout and insert, but with the cushiony midsole center part as described above. In the latter instance, the insole spreads the wearer's weight over the entire surface of the midsole to achieve long-lasting, cushiony support at the entire forepart of the shoe. The midsole may alternately be provided without the outer stabilizing perimeter part to purposely achieve a unique visible "bulging" of the midsole as the shoe is walked in. The invention is applicable to other shoe types, such as shoes with an outsole and heel molded as a one-piece unit, and shoes with partially or substantially closed uppers, and with "wedges" and high heel boots. A shoe constructed in accordance with the invention may include an additional thickness of cushion at the heel end. In the embodiment shown, the arch end of the midsole outer part is open, and is filled with the arch end of the midsole center part 48. In alternate embodiments, the arch end of the midsole outer part is provided as closed or connected, and in such instances, is preferably located at or behind (toward the heel end) of the edge 30 of the cutout 28 in the insole blank 24, to insure the forepart of the wearer's foot is fully supported by the preferred double-cushioned configuration of the insole and midsole as through the cutout 28. Skilled artisans will readily devise additional alternate embodiments in accordance with the invention. It will also be evident that, although the invention is most advantageous in shoes with heels (or wedges) of one inch or greater, due to the increase in pressure at the front of the wearer's foot resulting therefrom, the construction and method for making a shoe as described herein can be applied to shoes that have lower heels and even for flats.

From the foregoing, it will be apparent that the present invention brings to the art new and unique shoe construction which includes a cushiony midsole to absorb the pressure at the front of the wearer's foot, create a high heel shoe that can be comfortably worn for extended periods of time, and eliminating the discomfort associated with prior high heel shoes. The uniquely constructed cushioned insole of the preferred embodiment cooperates with the unique cushiony midsole to transfer a substantial portion of the wearer's weight through the forepart of the foot and into the midsole cushion. The result is a cushioned combination that divides and transfers the pressure to both the cushioned insole and the cushioned midsole, and which is especially useful in high heel shoes with leather outsoles. Accordingly, the invention uniquely addresses prior disadvantages of wearing high heel shoes which results in additional pressure at the front of the wearer's feet.

I claim:

1. A shoe comprising:

a) an insole comprising an insole blank with a top and a bottom and an insole cushion secured over the insole blank, the insole having a forepart with an outer perimeter, a heel end, and an arch profile therebetween, the insole further having a covering wrapped snugly over at least the top forepart of the cushion and around the outer edges of the top cushion and the insole blank;

b) an upper connected in fixed relation to and located generally above the insole;

c) an outsole having a forepart, a heel end, and an arch profile corresponding to respective parts of the insole, the forepart of the outsole being connected in fixed spaced relation below the forepart of the insole, and the heel end of the outsole being connected in fixed relation below the heel end of the insole;

d) a midsole secured in position between the foreparts of the insole and outsole, the midsole having an outer perimeter generally tracking the outer perimeter of the insole and outsole, the midsole comprising a soft cushion in compressible contacting relation between the foreparts of the insole and outsole; and e) a heel extending downwardly from the heel end of the outsole to raise the heel end of the outsole and insole to a height of at least one inch above the foreparts thereof.

2. The shoe as defined in claim 1 in which the midsole cushion is characterized with a compression deflection of approximately 25% with a compressive pressure of between approximately 2 to 12 psi applied thereto.

3. The shoe as defined in claim 2 in which the midsole cushion is provided from foam rubber cushion material.

4. The shoe as defined in claim 2 in which the midsole cushion is provided from one of an air-bubble cushion and a gel cushion.

5. The shoe as defined in claim 1 in which the insole blank is formed with a generally open forepart through the thickness thereof and generally surrounded by the perimeter thereof whereby pressure on the forepart of the insole cushion is transferred through the open forepart of the insole blank to the midsole cushion.

6. The shoe as defined in claim 5 further comprising a flexible insert in the open forepart of the insole blank to aid in transfer of pressure on the forepart of the insole cushion through to the midsole cushion, the insert and the outer perimeter of the insole blank having approximately the same thickness.

7. A shoe comprising:

a) an insole comprising an insole blank with a top and a bottom and an insole cushion secured over the insole blank, the insole having a forepart with an outer perimeter, a heel end, and an arch profile therebetween;

b) an upper connected in fixed relation to and located generally above the insole;

c) an outsole having a forepart, a heel end, and an arch profile corresponding to respective parts of the insole, the forepart of the outsole being connected in fixed spaced relation below the forepart of the insole, and the heel end of the outsole being connected in fixed relation below the heel end of the insole;

d) a midsole secured in position between the foreparts of the insole and outsole, the midsole comprising an outer stabilizing perimeter part generally tracking the outer perimeter of the insole and outsole, and a distinct soft center cushion part located in the perimeter part in compressible contacting relation between the foreparts of the insole and outsole, the center cushion part and the stabilizing perimeter part having approximately the same thickness; and e) a heel extending downwardly from the heel end of the outsole.

8. The shoe as defined in claim 7 in which the midsole cushion part is characterized with a compression deflection of approximately 25% with a compressive pressure of between approximately 2 to 12 psi applied thereto.

9. The shoe as defined in claim 8 in which the midsole outer stabilizing perimeter part is provided from firm foam rubber cushion material, and the midsole cushion part is provided from soft foam rubber cushion material.

10. The shoe as defined in claim 9 in which the midsole outer stabilizing part is characterized with a compression deflection of approximately 25% with a compressive pressure of at least approximately 20 psi applied thereto.

11. The shoe as defined in claim 7 in which the midsole cushion part is provided from one of an air-bubble cushion and a gel cushion.

12. The shoe as defined in claim 7 in which the midsole outer stabilizing perimeter part is provided from one of molded rubber or molded plastic.

13. The shoe as defined in claim 7 in which the insole blank is formed with a generally open forepart through the thickness thereof and generally surrounded by the perimeter thereof whereby pressure on the forepart of the insole cushion is transferred through the open forepart of the insole blank to the midsole cushion part.

14. The shoe as defined in claim 13 further comprising a flexible insert in the open forepart of the insole blank to aid in transfer of pressure on the forepart of the insole cushion through to the midsole cushion part, the insert and the outer perimeter of the insole blank having approximately the same thickness.

15. The shoe as defined in claim 7 in which the heel is sized to raise the heel end of the outsole and insole to a height of at least one inch above the foreparts thereof.

16. A shoe comprising:

a) an insole comprising an insole blank with a top and a bottom and an insole cushion secured over the insole blank, the insole having a forepart with an outer perimeter, a heel end, and an arch profile therebetween, the forepart of the insole blank having an opening through the thickness thereof and generally surrounded by the outer perimeter;

b) an upper connected in fixed relation to and located generally above the insole;

c) an outsole having a forepart, a heel end, and an arch profile corresponding to respective parts of the insole, the forepart of the outsole being connected in fixed spaced relation below the forepart of the insole, and the heel end of the outsole being connected in fixed relation below the heel end of the insole;

d) a midsole secured in position between the foreparts of the insole and outsole, the midsole comprising an outer stabilizing perimeter part generally tracking the outer perimeter of the insole and outsole, and a distinct soft center cushion part located in the perimeter part in compressible contacting relation between the foreparts of the insole and outsole, the center cushion part and the stabilizing perimeter part having approximately the same thickness;

e) a flexible material insert generally filling the thickness of the opening in the insole blank, the insert and the outer perimeter of the insole blank having approximately the same thickness; and f) a heel extending downwardly from the heel end of the outsole.

17. The shoe as defined in claim 16 in which the midsole cushion part is characterized with a compression deflection of approximately 25% with a compressive pressure of between approximately 2 to 12 psi applied thereto.

18. The shoe as defined in claim 17 in which the midsole outer stabilizing perimeter part is provided from firm foam rubber cushion material, and the midsole cushion part is provided from soft foam rubber cushion material.

19. The shoe as defined in claim 18 in which the midsole outer stabilizing part is characterized with a compression deflection of approximately 25% with a compressive pressure of at least approximately 20 psi applied thereto.

20. The shoe as defined in claim 17 in which the heel is sized to raise the heel end of the outsole and insole to a height of at least one inch above the foreparts thereof.

21. The shoe as defined in claim 7 in which the midsole is formed with a tapered back edge proximately aligned below the arch profile of the insole.

22. The shoe as defined in claim 7 in which the center cushion part and the stabilizing perimeter part of the midsole are secured together with a wrap that covers the outer edges of the stabilizing perimeter part.

23. The shoe as defined in claim 16 further comprising a covering wrapped snugly over at least the top forepart of the cushion and around the outer edges of the top cushion and the insole blank.

* * * * *